US008899687B2

(12) United States Patent
Krause et al.

(10) Patent No.: US 8,899,687 B2
(45) Date of Patent: Dec. 2, 2014

(54) PUZZLE SEATING

(75) Inventors: Martin Krause, Ft. Wayne, IN (US); Donald Newfer, Auburn, IN (US); Steven Stieglitz, Harlan, IN (US)

(73) Assignee: Sauder Manufacturing Co., Archbold, OH (US)

( * ) Notice: Subject to any disclaimer, the term of this patent is extended or adjusted under 35 U.S.C. 154(b) by 309 days.

(21) Appl. No.: 12/907,682

(22) Filed: Oct. 19, 2010

(65) Prior Publication Data

US 2012/0091768 A1 Apr. 19, 2012

(51) Int. Cl.

| | |
|---|---|
| ***A47C 7/00*** | (2006.01) |
| ***A47C 15/00*** | (2006.01) |
| ***A47C 13/00*** | (2006.01) |
| ***A47C 7/02*** | (2006.01) |
| ***A47C 4/02*** | (2006.01) |

(52) U.S. Cl.

CPC ..... *A47C 4/02* (2013.01); *A47C 13/005* (2013.01); *A47C 7/021* (2013.01)

USPC ..... 297/440.13; 297/233

(58) Field of Classification Search

USPC ..... 297/440.1, 440.15, 440.11, 440.14, 297/248, 440.13, 233

See application file for complete search history.

(56) References Cited

U.S. PATENT DOCUMENTS

| | | | | |
|---|---|---|---|---|
| 1,419,647 | A * | 6/1922 | Shepherdson | 297/440.13 |
| 3,162,484 | A * | 12/1964 | Kleffman | 297/248 |
| 3,563,599 | A * | 2/1971 | Heumann | 297/218.5 |
| 3,807,801 | A * | 4/1974 | Dalsgard | 297/452.16 |
| 5,080,438 | A * | 1/1992 | Moyer | 297/440.23 |
| 7,104,864 | B1 * | 9/2006 | Liou | 446/221 |
| 2006/0220435 | A1 * | 10/2006 | Carter et al. | 297/440.14 |
| 2006/0288546 | A1 * | 12/2006 | Wu | 24/615 |
| 2007/0085406 | A1 * | 4/2007 | White et al. | 297/440.1 |

* cited by examiner

*Primary Examiner* — Milton Nelson, Jr.

(74) *Attorney, Agent, or Firm* — Varnum, Riddering, Schmidt & Howlett LLP

(57) ABSTRACT

A seating assembly with a base, a seat and a back which have interlocking features, and a strap latch removeably securing the back to the base with a portion of the seat sandwiched therebetween. The strap latch comprises a strap affixed to one component, with a latch attached to its free end, and a catch member affixed to another component. The seat may also be configured to appear horizontal but to have a rearward incline when occupied, by affixing the seat webbing to a fixed forward member and a floating rear member, and attaching the floating member to a fixed rear member via straps, wherein the straps and the seat webbing have sufficient elasticity to allow the floating member to be depressed when a downward force is applied to the seat.

22 Claims, 12 Drawing Sheets

PUZZLE SEATING

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE OR A COMPUTER PROGRAM LISTING COMPACT DISC APPENDIX

Not applicable.

BACKGROUND OF THE INVENTION

The invention is in the field of seating design and construction.

BRIEF SUMMARY OF THE INVENTION

The invention comprises a seating assembly of first and second seating components releasably secured together without the need for tools, by at least one strap latch. The strap latch comprises a strap with one end of the strap affixed to the first component and the other end of the strap affixed to a latch. The latch of the strap latch releasably engages a catch which is affixed to the second component.

Preferably, three or more components are releasably joined without the need for tools by using a combination of one or more component interlocking features and at least one strap latch. Also in a preferred embodiment, adjacent seating units can be ganged together using a strap latch.

The seating assembly may also feature a seat support with fixed forward and rear frame members, and a floating rear frame member attached to the fixed rear frame member with at least one strap, with the seating web attached along its front edge to the fixed forward frame member and along its back edge to the floating rear frame member. This seat support appears to be horizontal when unoccupied, but the seat webbing and strap have sufficient stretch such that when a downward force is applied to the seat, the floating rear frame member is depressed, such that the seat has a rearward incline. This allows for a seat that appears flat, but feels inclined to the occupant.

DETAILED DESCRIPTION OF THE PREFERRED EMBODIMENTS

Figure 1:
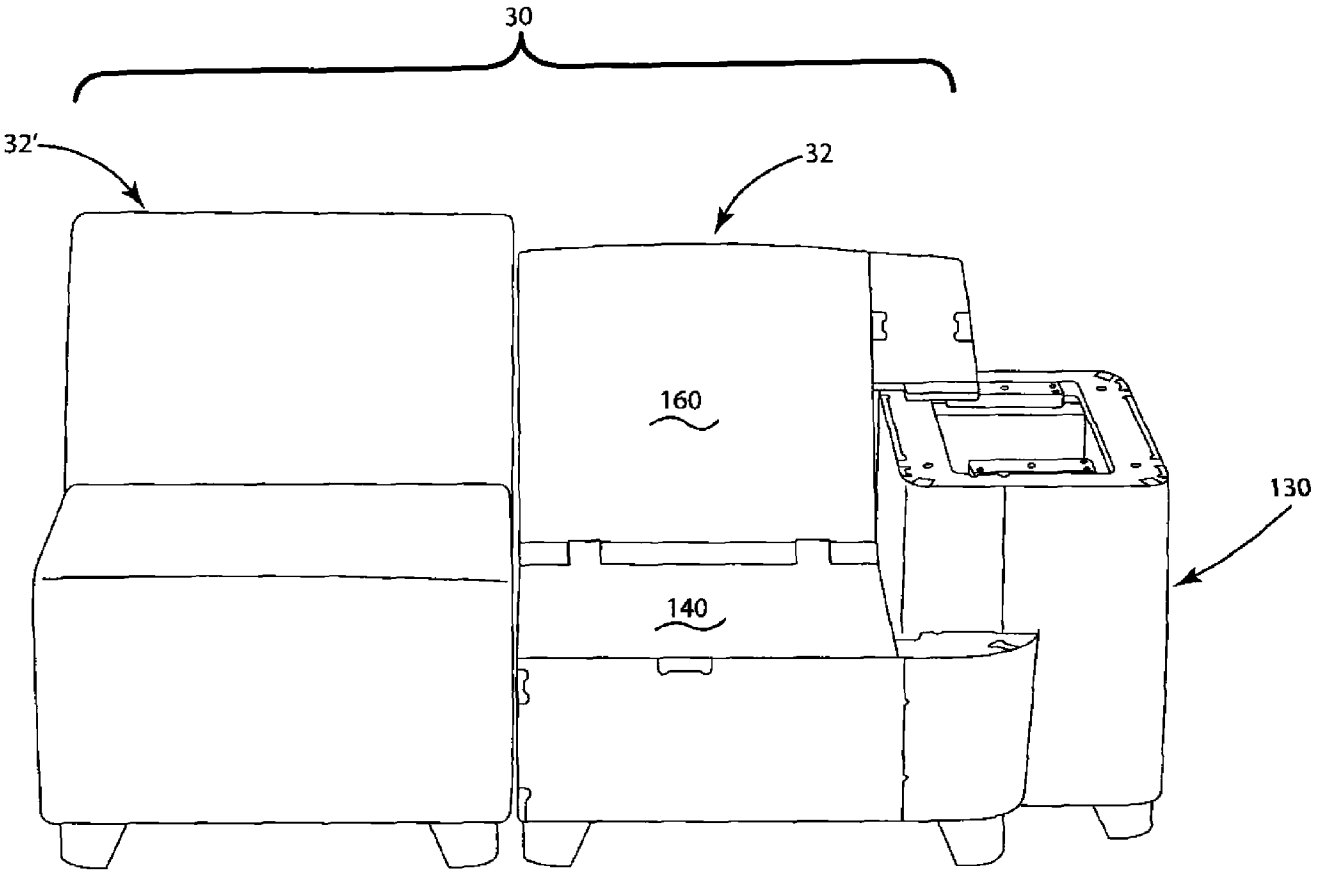
FIG. 1 is a front perspective view of a chair with a tablet arm, completely assembled, but without cushions, while ganged to a second upholstered chair.
Figure 2:
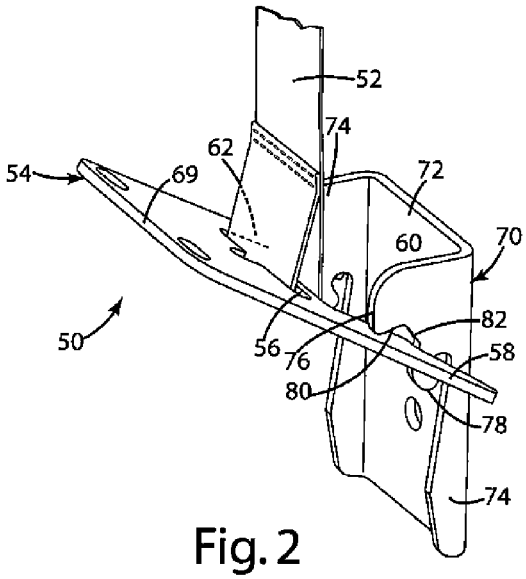
FIG. 2 is a detailed top perspective view of a latch with the strap attached.
Figure 2A:
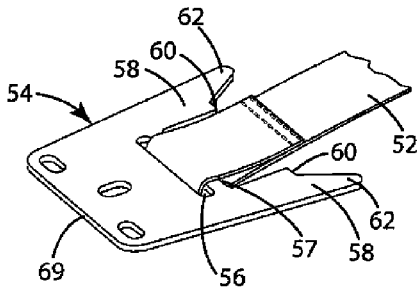
FIG. 2A is a detailed view of a latch and a catch in the ready position, showing alignment of the strap.

FIG. 1 shows a ganged seating assembly 30 of two preferred embodiment chair assemblies 32 and 32', one of which (32) is shown un-upholstered and with an optional tablet arm 130, and the other of which (32') is shown upholstered. Each chair assembly 32 includes a base 90 (FIG. 4), an interlocking seat 140, a back 160, and an optional tablet arm 130 (FIG. 1). In the preferred embodiment, these components are modularly connected in an interlocking manner, without the need for tools and are secured together by one or more strap latches 50 (FIGS. 2-3). Strap latches 50 are also used to attach, or "gang" one chair assembly 32 to an adjacent chair assembly 32' to form a seating assembly 30 which is capable of being configured in a custom manner (FIG. 1).

Strap latch 50 comprises a strap 52 secured to one chair assembly 32 component, with a latch 54 at one end of the strap 50, which engages a catch 70 mounted on another chair assembly 32 component (FIGS. 2-3). The strap 50 has one end affixed to a component of the chair assembly 32 and the other end rotatably attached to the latch 54, e.g., by passing the end of the strap 50 through a slot 56 in the latch 54 and wrapping the strap 50 around the intermediate portion 57 of the latch 54 located between the catch engaging projections 58 on the leading edge of the latch 54 and fastening the end of the strap 50 to the trailing portion of strap 50 (FIG. 2). The leading edge of latch 54 is defined by two spaced catch engaging projections 58, each comprising a flat catch engaging edge 60 to engage the catch 70, and tabs 62 outside of and projecting beyond the flat catch engaging edge 60 to prevent side to side motion of the latch 54 once it is in place on the catch 70. The trailing edge 69 of latch 54 opposite the two catch engaging leading edge portions 60 serves as a handle which can be used to fasten the strap latch 50 to catch 70.

The catch 70, in one preferred embodiment, comprises a back plate 72 with two projecting sides 74, each projecting side 74 having a flat catch or fulcrum protrusion 76 and a rounded stop protrusion 78. The fulcrum protrusion 76 is characterized by an overhanging flat edge 80 positioned such that the flat edge 80 has an angle of at least about ninety degrees (90°), and preferably an oblique angle of greater than about ninety degrees (90°), from the direction that the strap 50 will approach from, and an angled edge 82 which angles back toward the back plate 72. The rounded stop 78 is located farther from the direction of approach of the strap 52 than the flat fulcrum protrusion 76 and does not extend as far from the back plate 72 as the fulcrum protrusion 76. The rounded stops 78 serve as a stop for the latch 54 as it is moved from the ready position to the locked position, and prevent the latch 54 from rotating any further than just slightly over center relative to fulcrum 76 when the latch 54 is held in engagement with protrusion 76 by the tension placed on latch 54 by strap 52.

Figure 3A:
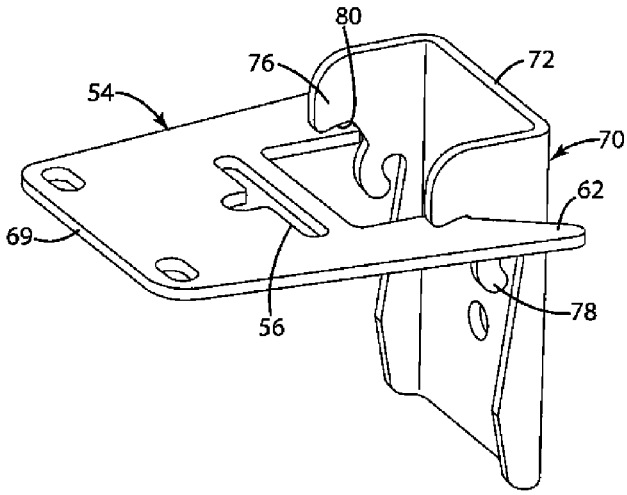
FIGS. 3A-3C are detail views of the latch in its various positions as it is pivoted over center into its locked position in the catch, with the strap not shown, for purposes of clarity.
Figure 3C:
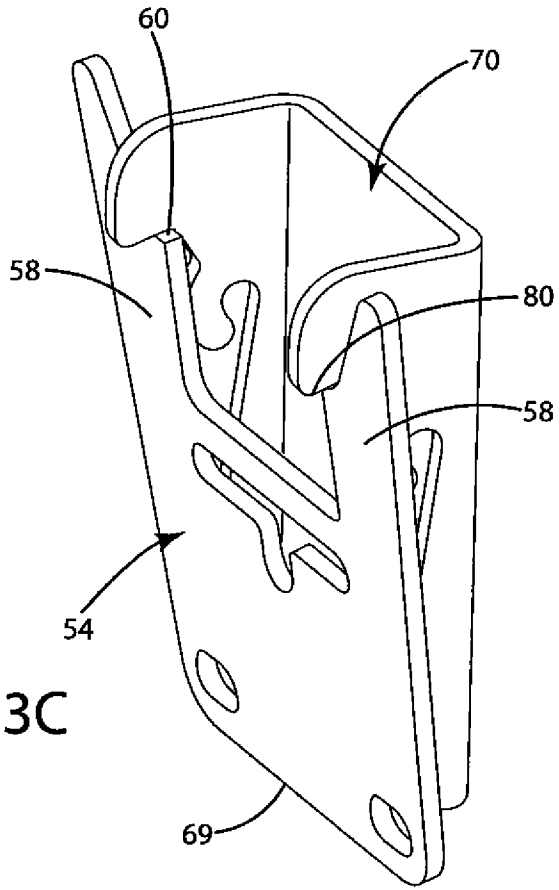
Figure 3B:
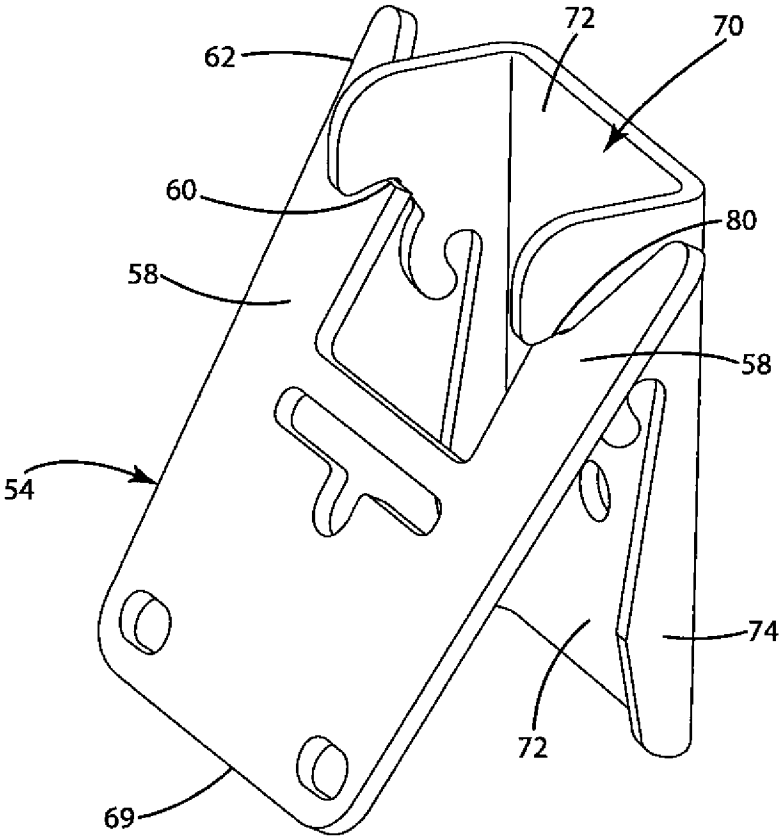
Figure 4:
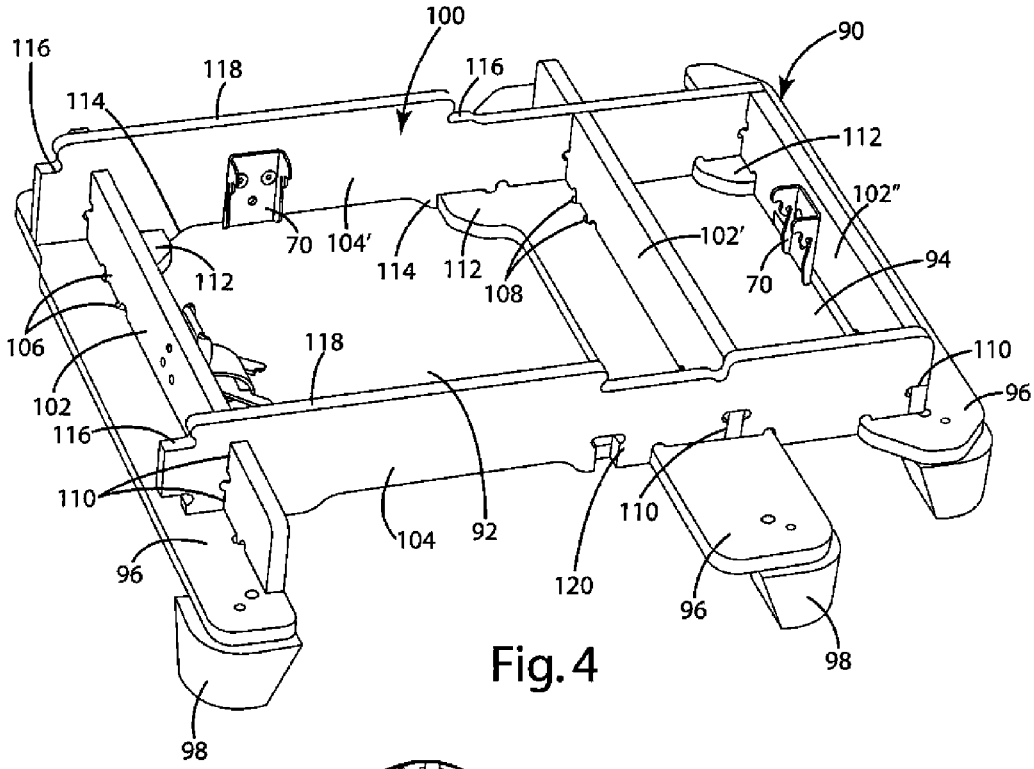
FIG. 4 is a perspective view of the base, configured to receive a chair and a tablet arm.

To operate the strap latch 50, the latch 54 is placed perpendicularly to the catch 70, with the flat catch engaging edges 60 of the latch 54 against the catch 70 between the fulcrum protrusions 76 and the rounded stop protrusions 78. (FIG. 2) Then the latch 54 is rotated toward the round stop protrusions 78 such that the flat catch engaging edges 60 are in contact with the fulcrum protrusions 76, and the latch 54 is cammed over center relative to fulcrum protrusions 76 (FIGS. 3A, 3B, 3C). The length of strap 52 is such that in this position, the latch 54 is applying a stretching force on strap 52, which pulls the catch engaging edges 60 of latch 54 against the fulcrum protrusions 76 and the trailing edge 69 of latch 54 toward the rounded stop protrusions 78, thereby locking latch 54 against catch 70 until someone applies a counter rotating force to rotate latch 54 back the other way.

In one example of a preferred embodiment, the base 90 is configured to accommodate a seat 140, back 160 and a tablet arm 130. (FIG. 4) Base 90 includes a chair accommodating portion 92 and a tablet arm accommodating portion 94. Base 90 has three horizontally oriented base members 96 extending from the front to the back of the base 90, one at the outside edge of the chair accommodating portion 92, one dividing the chair accommodating portion 92 and the tablet arm accommodating portion 94, and one at the outside edge of the tablet arm accommodating portion 94. The horizontal base member 96 dividing the chair accommodating portion 92 and the tablet arm accommodating portion 94 may be wider than the other horizontal base members 96, to accommodate the width of the tablet arm 130 and the seat support 140, with the additional width extending into the chair accommodating portion of the base 92. Each horizontal base member 96 may optionally be fitted with a foot 98 near its front edge and back edge so that the base 90 is lifted off of the ground. (If the seating assembly 32 was not intended to include an arm, the base may utilize only two horizontal base members 96, as the horizontal base member to support the outer edge of the tablet arm 130 would be unnecessary.)

To define the chair accommodating portion 92 and the tablet arm accommodating portion 94, and to provide a basis for the installation of these items, a base frame 100 is provided on top of the horizontal base members 96. The base frame 100 includes three members 102 (102, 102', 102") extending from front-to-back (one over each horizontal base member 96) and two base frame members 104 (104, 104') extending side-to-side across the chair assembly 32, one at the back, and one at the front. At intervals along the length of the base frame members 102, 104, downwardly extending fingers 106 may be provided, which extend through corresponding holes 108 in the horizontal base member 96 to form mortise and tenon joints between the horizontal base members 96 and the base frame members 102, 104. The base frame members 102, 104 each have complimentary slots 110 cut approximately halfway through their depth so that, where they intersect, the members 102, 104 interlock to form a cross lap joint. A catch 70 is secured to frame member 102" for receiving the latch 54 of a strap latch 50 secured to tablet arm 130. Another catch 70 is secured to back frame member 104', in the center of the chair supporting portion of base 90. This facilitates securing back 160 in place. Additional base frame members 102, 104 could be provided. For example, additional side-to-side base frame members 104 could be provided between the front and rear base frame members 104 to add stability to the base frame 100.

The horizontal base members 96 may also be provided with interior corner tabs 112, extending inwardly to the chair accommodating portion 92 and the tablet accommodating portion 94 of the base frame 100 at each interior corner. Downwardly-extending tab engaging members 114 may then be provided on the base frame members 102, 104, to engage the tabs 112 and further stabilize the base frame 100 on the horizontal base members 96.

In the chair accommodating portion 92, the top edge of the side-to-side base frame members 104 have notches 116 therein at each of the four corners where the seat 140 will be attached, with the edge 118 between the notches 116 being raised. The bottom edge of the forward side-to-side base frame member 104 may also be provided with one or more seat receiving slots 120, for example, two slots 120, one at each side of the chair accommodating portion 92.

Figure 5:
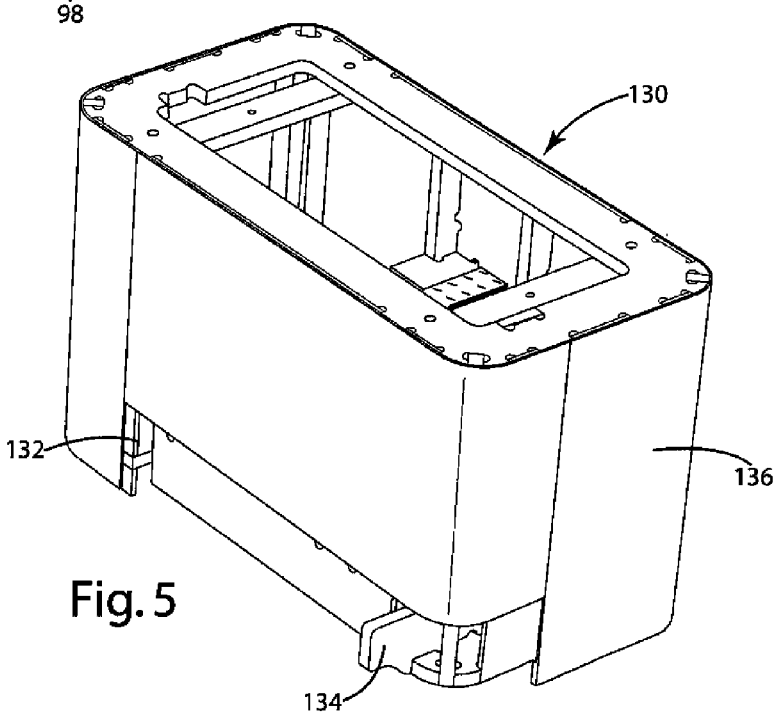
FIG. 5 is a perspective view of a tablet arm.

A tablet arm 130, with a flat area on top which can be covered to create a writing surface may be included in the chair assembly 32. (FIGS. 5, 6) The bottom of the tablet arm 130 is configured to fit over the outside of the tablet arm receiving portion 94 of base 90, with the tablet arm 130 having slots 132 along the bottom interior edge, corresponding with the side-to-side base frame members 104 so that the bottom of the tablet arm 130 rests on the horizontal base members 96, with the side-to-side base frame members 104 passing through the slots 132. The bottom of the tablet arm 130 may also include one or more interlocking projections 134 which extend perpendicularly from the tablet arm 130, adjacent to one or more of the side-to-side base frame members 104. The sides of the tablet arm 130 may be enclosed with solid walls 136, if desired.

Figure 6:
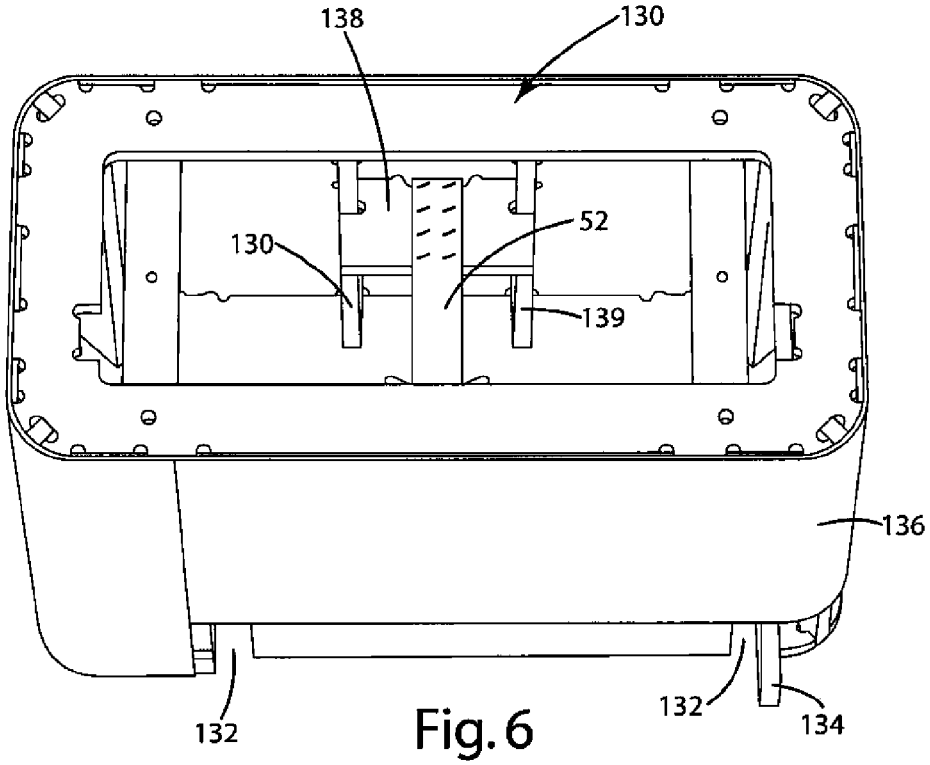
FIG. 6 is a top perspective view of the interior of the tablet arm, and the H-shaped brace and strap latch.
Figure 7:
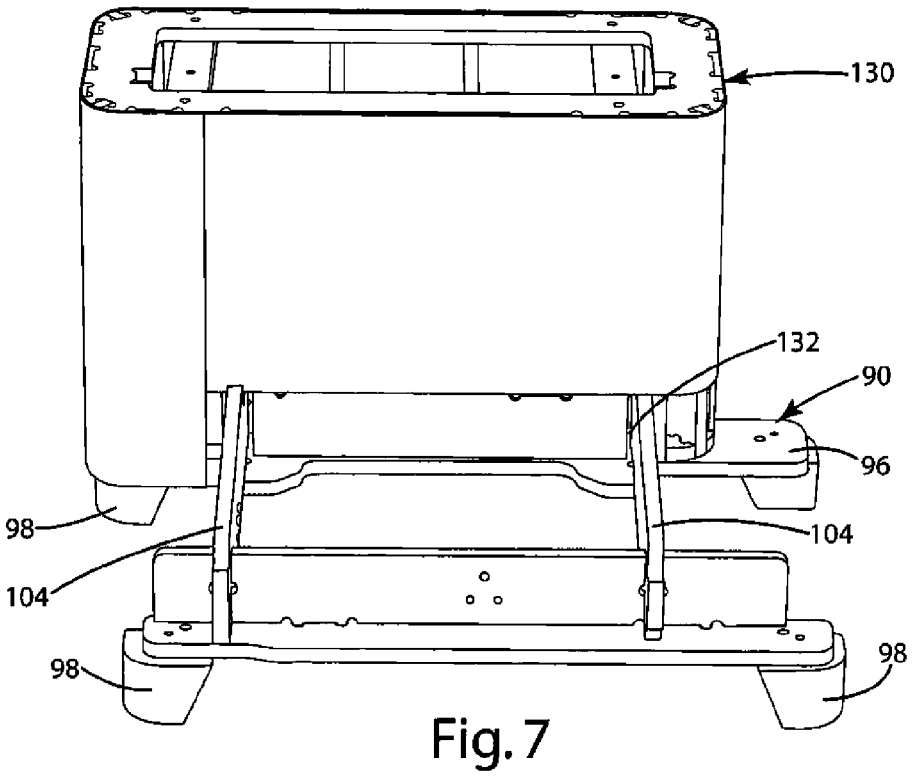
FIG. 7 is a side perspective view of the base with the tablet arm installed thereon.
Figure 8:
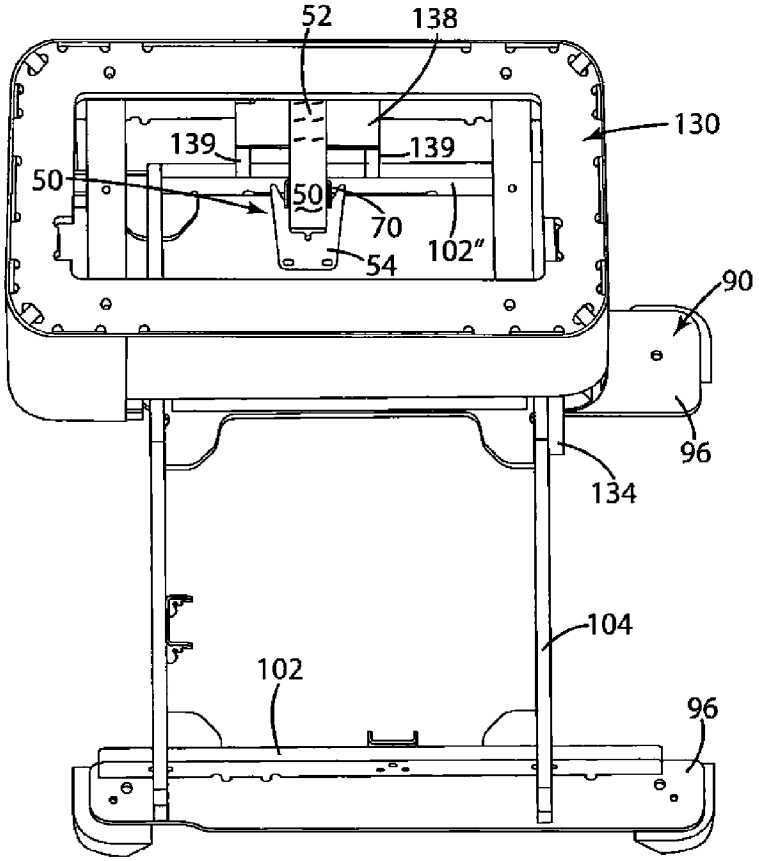
FIG. 8 is a top perspective view of the base and the tablet arm, with the strap latch in the ready position.

The interior side of the wall 136 of the tablet arm 130 may be provided with an H-shaped brace comprising a horizontal platform 138, and two vertically extending legs 139. The brace may also be an upside down U-shaped brace with a horizontal platform 138 and two downwardly extending vertical legs 139. When arm 130 is assembled to base 90, legs 139 rest on top of the front-to-back base frame member 102" thereby supporting the horizontal platform 138. (FIGS. 6, 8)

Figure 9:
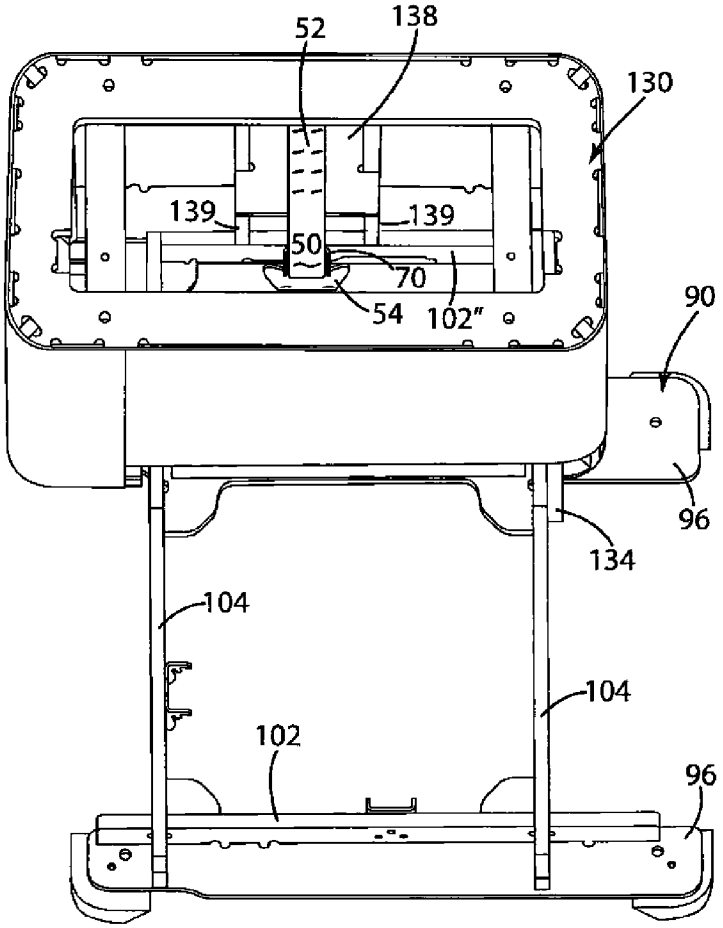
FIG. 9 is a top perspective view of the base and the tablet arm, with the strap latch in the latched position.

The tablet arm 130 is installed by placing the tablet arm 130 over the tablet arm accommodating portion 94 of the base 90, so that the base frame members 104 and 104' are positioned within the corresponding slots 132 on the tablet arm 130. The interlocking projection 134 extends along the side-to-side base frame member 104, and the brace 138, 139 is positioned directly on top of the front-to-back base frame member 102". Then, the latch 54 of a strap latch 50, comprising a strap 52 which is securely fastened to brace top platform 138 at one end, and having a latch 54 attached to the free end, is engaged into fixed catch 70 on frame member 102". This secures the tablet arm 130 to the base 90. The catch 70 is securely attached to the middle front-to-back base frame member 102" directly below the H-shaped brace 138, 139 facing in toward the center of the tablet arm 130. The strap 52 may be attached to the top of the brace 138 using any method known in the art, and the catch 70 may be fastened to the base frame member 102 using any method known in the art, including staples, nails, screws, bolts, adhesives, tape, or any other known method of fastening. The latch 54 is placed in the ready position adjacent to the catch 70, as described above, and is then rotated into the locked position, such that the strap 52 is pulled taut, holding the tablet arm 130 securely to the base 90 (FIGS. 8, 9).

Figure 10:
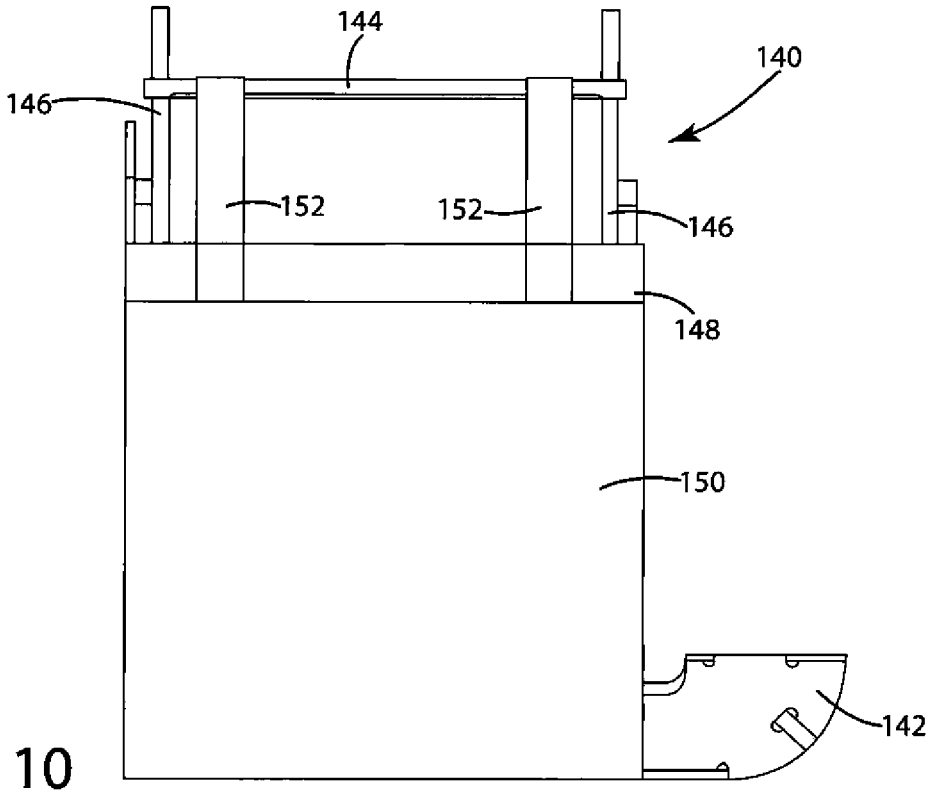
FIG. 10 is a top view of the seat.
Figure 11:
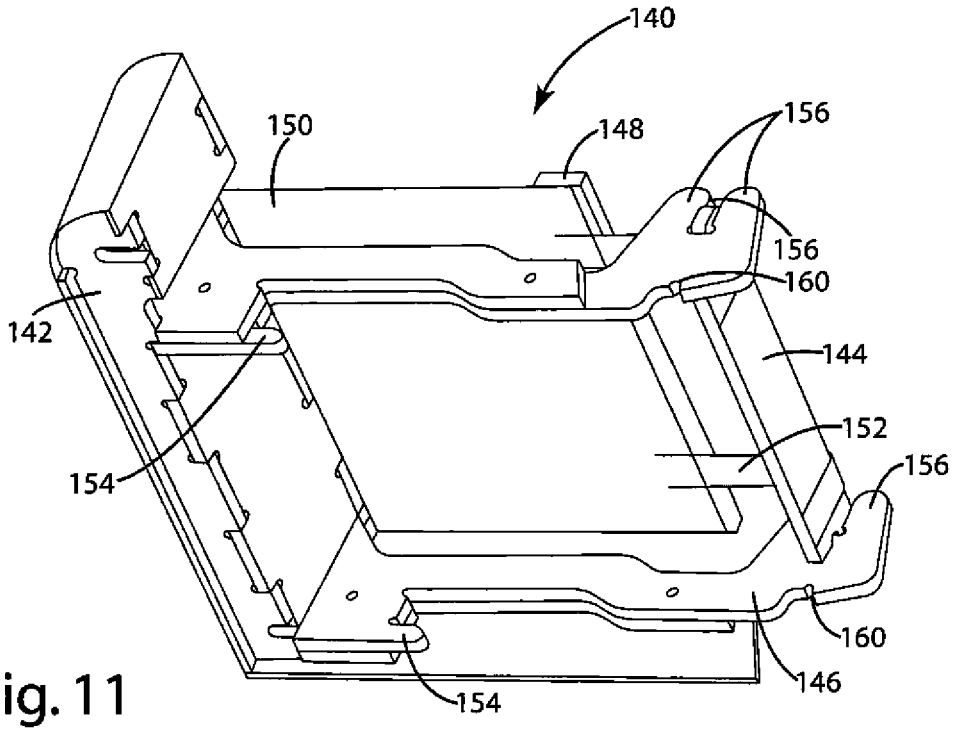
FIG. 11 is a bottom perspective view of the seat.

A seat 140, preferably having a fixed forward frame member 142, a fixed rear frame member 144, side rails 146, a floating rear frame member 148, seat webbing 150 and preferably at least two straps 152 affixing the floating frame member 148 to the fixed rear frame member 144. (FIGS. 10, 11) The fixed forward frame member 142 has at least one rearwardly projecting tab 154, which corresponds with the seat support receiving slot 120 in the forward side-to-side base frame member 104. The side rails 146 are attached to the fixed forward frame member 142 and are configured to rest on top of the base frame 100. At the rear of the seat support 140, the side rails 146 each have a pair of upwardly extending tapered members 156, defining a slot 158 therebetween for the fixed rear frame member 144 to be inserted. The side rails 146 may also be provided with a notch 160 on the bottom edge, which may be generally in line with the tapered members 156, to correspond with the rear side-to-side base frame member 104' and assist to hold the seat support 140 in place over the base 90. The seat webbing 150 is fixedly attached to the fixed forward frame member 142 and the floating rear frame member 148, using any method known in the art for such attachment, including staples, nails, screws, adhesives, tapes, or any other known or equivalent method.

Figure 12:
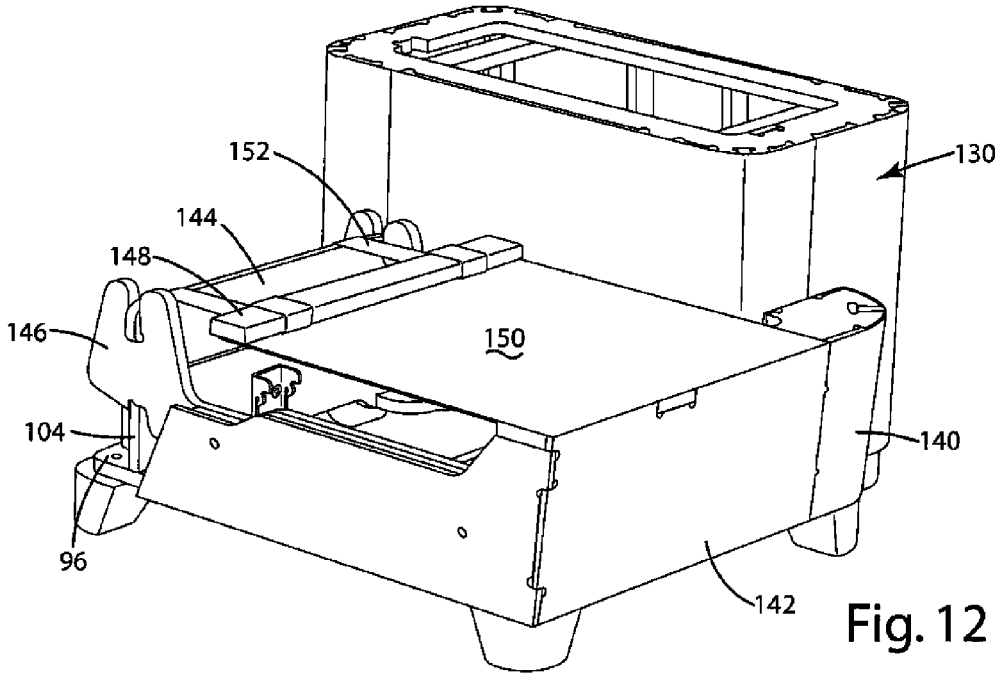
FIG. 12 is a top perspective view of the base, the tablet arm and the seat.
Figure 13:
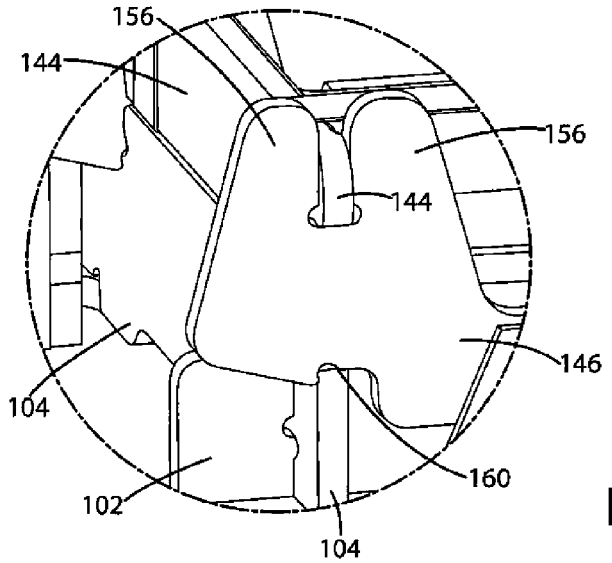
FIG. 13 is a detailed side view of the side rail of the seat and its interaction with the base of the chair.

To install the seat 140, it is placed over the chair accommodating portion of the base 92 by inserting the rearwardly projecting tabs 154 into the seat support receiving slots 120 on the forward side-to-side base frame member 104, sliding seat 140 rearwardly, and then lowering the back portion of the seat support 140, so that the notch 160 rests on the top edge of the rear side-to-side base frame member 104, preventing movement of the seat support 140 in the front-to-back direction and the side rails 146 rest in notches 116 on top of the base frame members 104. (FIGS. 12, 13) When placed in position, the raised edges 118 engage with the interior of the side rails 146, thereby preventing lateral movement of the seat support 140 once it is placed in position. Side rail 146 of seat 140 is also then positioned over interlocking projection 134 of tablet arm 130, such that tablet arm 130 is additionally secured to base 90 by this interlocking relationship with seat 140.

Figure 14:
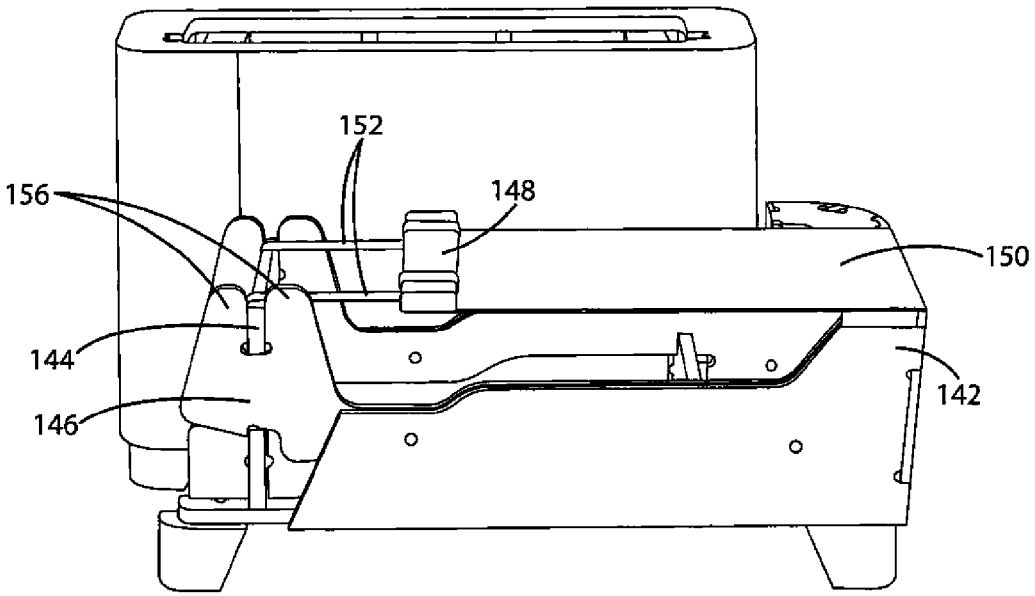
FIG. 14 is a slightly elevated side perspective view of the base, tablet arm and seat support, as it looks when the chair is un-occupied.
Figure 15:
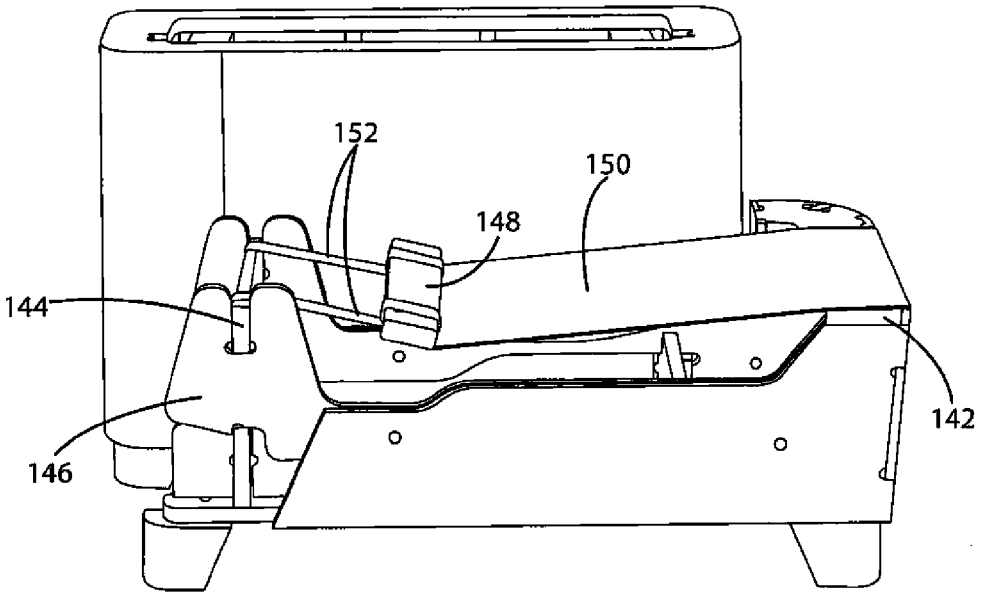
FIG. 15 is a slightly elevated side perspective view of the base, tablet arm and seat support, as it looks when the chair is occupied.

As described above, when the seat webbing 150 is attached along its back edge to the floating rear frame member 148, when no downward force is applied to the seat of the chair assembly 32, the floating rear frame member 148 is generally in the same plane as the fixed forward and rear frame members 142, 144, such that the seat of the chair assembly 32 appears to be generally horizontal. (FIG. 14) However, the seat webbing 150 and the straps 152 have sufficient stretch, such that when a downward force is applied to the seat of the chair assembly 32 the floating rear frame member 148 is permitted to move downward, such that the chair assembly 32, when occupied has a rearwardly inclined seat which is more comfortable for the occupant than a horizontal seat. (FIG. 15)

Figure 16:
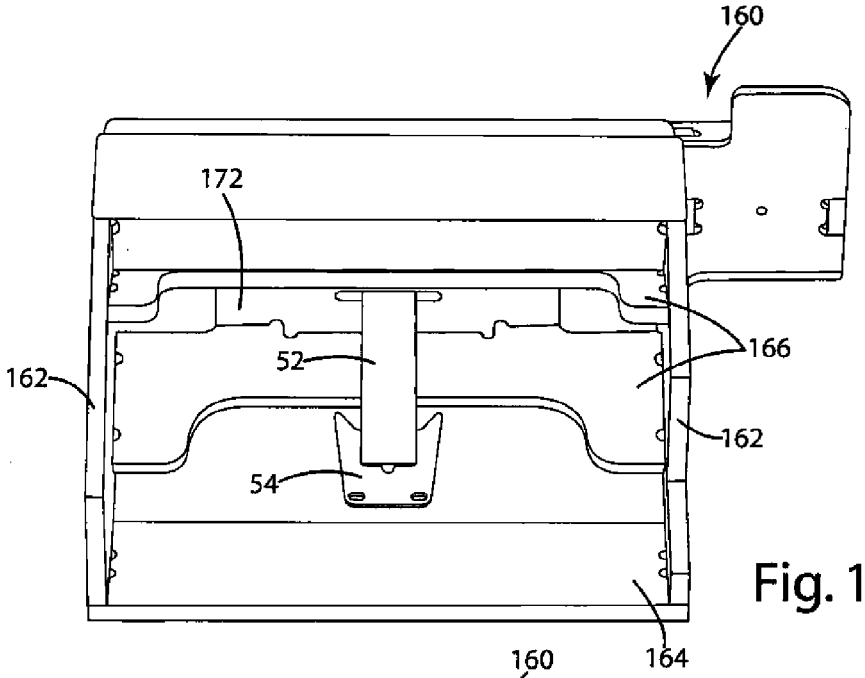
FIG. 16 is a bottom perspective view of the back.
Figure 17:
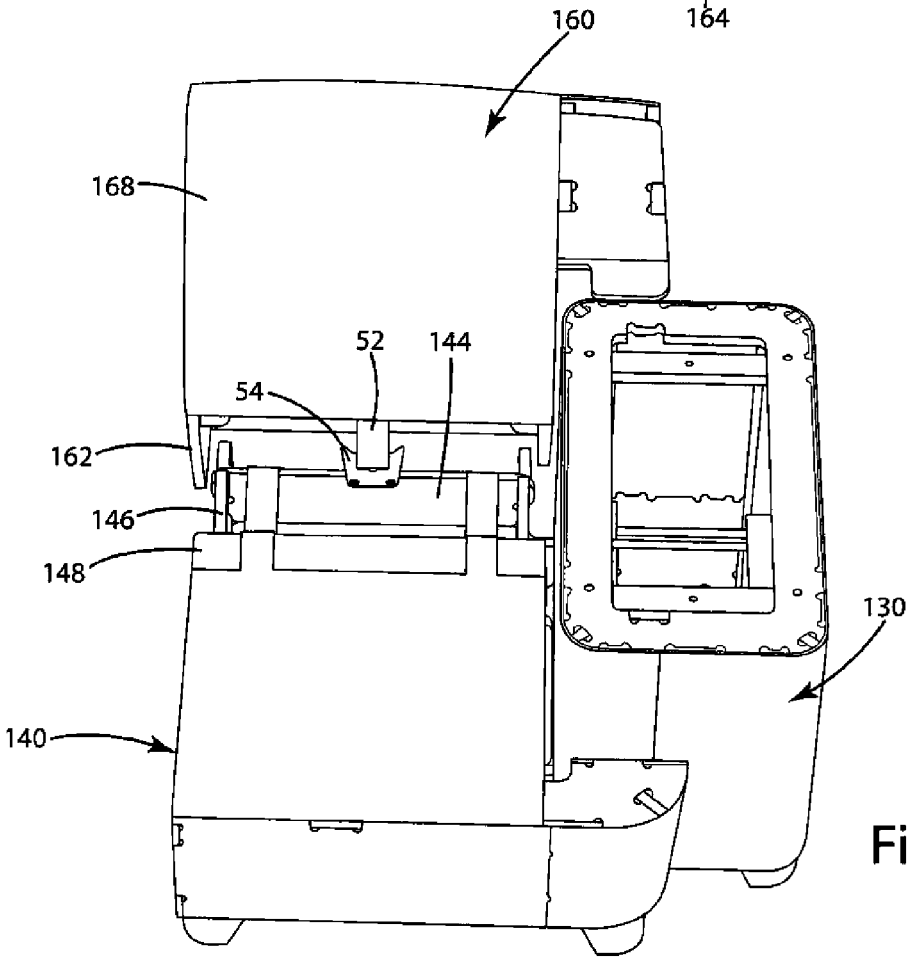
FIG. 17 is a top perspective view of the chair with the back lined up for attachment to the base and the seat.
Figure 19:
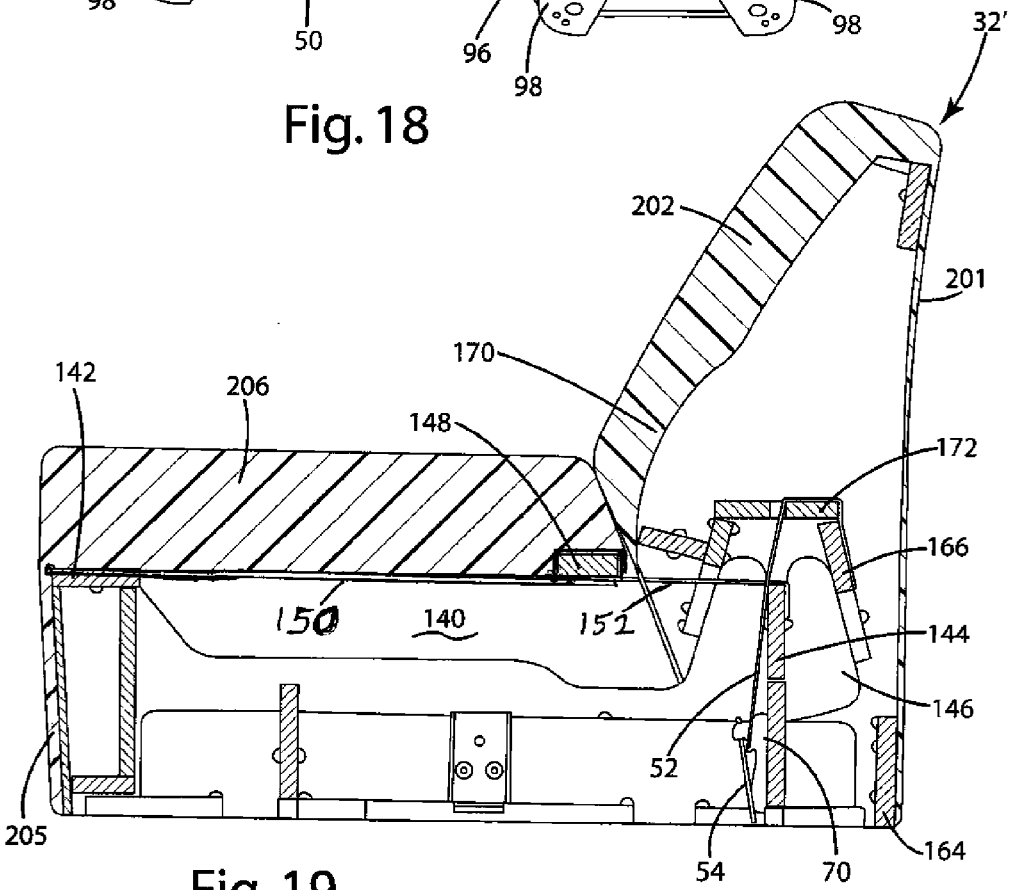
FIG. 19 is a cross sectional view of a chair.

After seat 140 is installed on the base 90, a back 160 may be installed. The back 160 comprises a pair of tapered side members 162, a bottom cross member 164, cross braces 166, and back webbing 168. (FIGS. 16-17, 19) The tapered side members 162 are spaced to fit around the outside of the seat side rails 146, and extend upward the height of back 160. The front edge of the tapered side members 162 may also be shaped to provide ergonomic support, such as by having a curved lumbar support region 170. The bottom cross member 164, extends across the rear bottom edge of the tapered side members 162. The cross braces 166 extend between the tapered side members 162, and are spaced and oriented so as to correspond to the upwardly extending tapered members 156 of the side rails 146, so that one cross brace 166 is on top of and in front of the upwardly extending tapered members 156 and the other cross brace 166 is on top of and behind the upwardly extending tapered members 156. A connecting brace 172 may also be placed between the cross braces 166, with a slit through the middle of the connecting brace 172 to permit attachment of the strap 52 on one of the cross braces 166, and then allow the strap 52 to go downward to interact with a catch 70 through the slit in the connecting brace 172.

To install, back 160 is placed into position over the seat 140, such that the cross braces 166 align with the corresponding upwardly extending tapered members 156. (FIG. 17) Back 160 is lowered, such that the cross braces 166 are adjacent to the upwardly extending tapered members 156, in the front and back thereof, limiting any front-to-back movement of the seat back 160, and due to the angle of the cross braces 166, also limiting the downward movement of the seat back 160. The bottom cross member 164 rests outside the rear of the base frame 100, preventing forward motion or backward rotation of the seat back 160.

Figure 18:
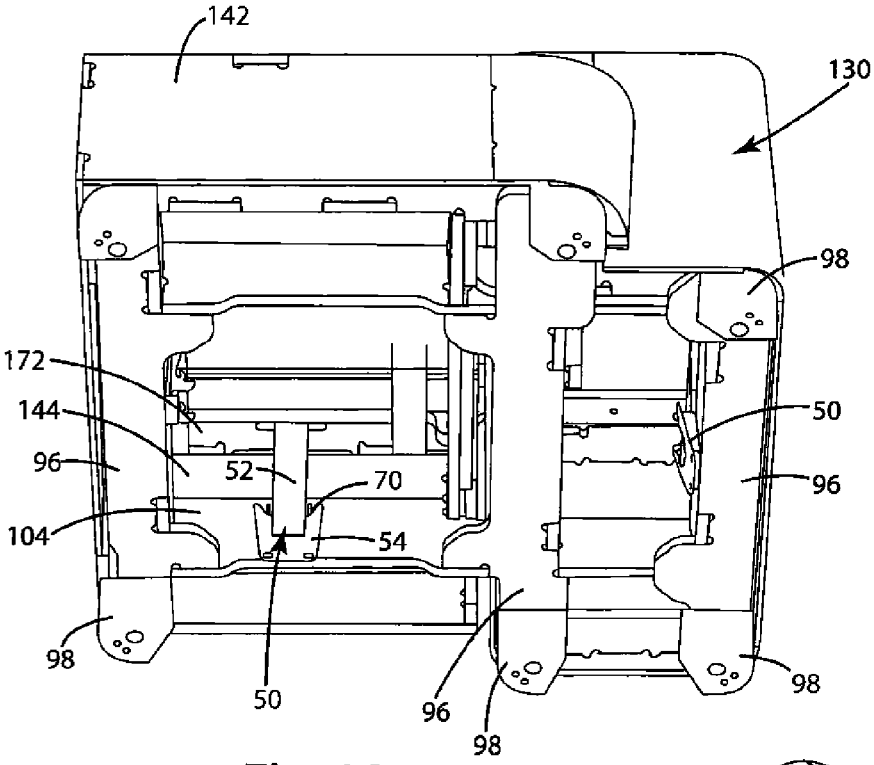
FIG. 18 is a bottom perspective view of the base, the seat and the back, showing the strap latch and order of stacking and interlocking of the elements.

A strap latch 50 extends downwardly from back cross brace 166, or optionally from the connecting brace 172, between the floating rear frame member 148 and the fixed rear frame member 144, to interact with a catch 70 placed on the interior wall of the rear side-to-side base frame member 104'. The strap latch 50 is fastened as described above to secure the seat back 160 to the base frame member 104', sandwiching the seat 140 between the base frame member 104' and back 160. (FIG. 18)

Preferably before the components of the chair assembly 32 are thus assembled, chair assembly 32 can be quickly and easily upholstered to provide a cushioned chair assembly 32'. (FIG. 19) An upholstered envelope 201 incorporating a back cushion 202 is slipped over back 160 and secured using hook and loop fasteners or the like. Similarly, an upholstery envelope 205 including a seat cushion 206 is slipped over seat 140 to finish it. Finally, an upholstery envelope is slipped over tablet arm 130. The upholstered components are then assembled without tools, as described above.

When the upholstery on the chair needs to be replaced, the components can be similarly separated for ease of removal of the old worn upholstery, and replaced with new upholstery envelopes, as discussed above. The newly upholstered components can then be reassembled in the manner discussed above.

Figure 20:
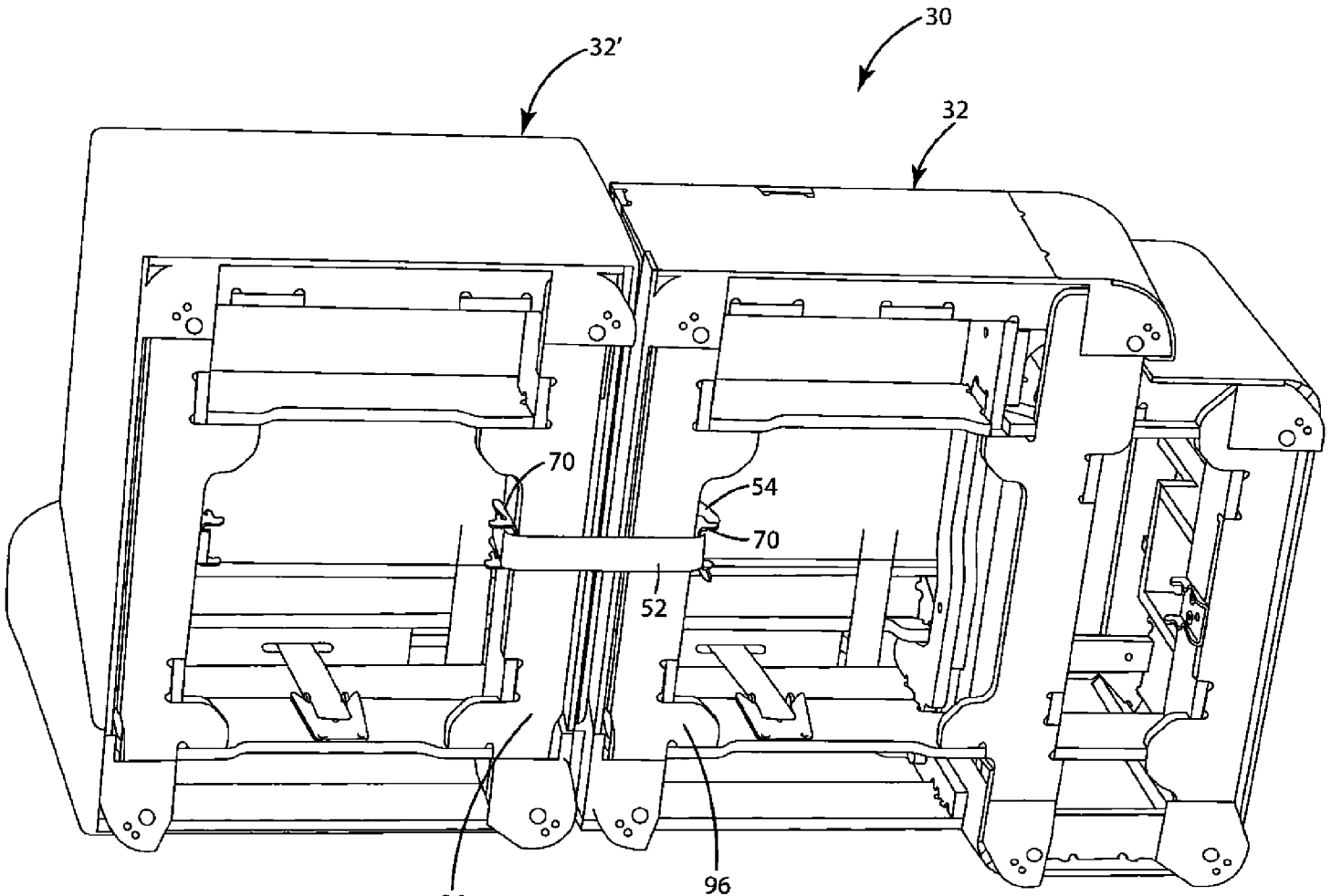
FIG. 20 is a bottom perspective view, showing the ganging of a first chair to a second chair.

Chairs 32 can be ganged together using a strap latch 50. To facilitate this, an additional strap latch 50 is provided on the interior side of the base frame member 102 of a first chair 32 that would be adjacent to a second chair 32' to form a grouped seating arrangement 30. (FIG. 20) The strap 52 is positioned to wrap underneath the horizontal base frame member 96 of the first chair assembly 32, under the horizontal base frame member 96 of the second chair assembly 32', and then up to a catch 70 provided on the interior of the base frame member of the second chair assembly 32'. A catch 70 may also be provided on the first chair assembly 32 where the strap 52 is fastened. The strap 52 and latch 54 can then be rolled up and secured to the catch 70 for storage when the first chair assembly 32 is not ganged to a second chair assembly 32'.

The chair and seating arrangements described herein may contain different components, for example, the tablet arm could be replaced by a regular arm, an arm with a different functionality, or be left off entirely; the seat could be replaced by a double- or triple-wide seat; the seat back could be configured in various manners or left off, and other configurations for each individual component are possible, and multiple components can be joined to form various seating arrangements.

Additionally, especially with reference to the system of notches, slots, tabs and other features to interlock the frames, it is understood that various arrangements of interlocking components may be provided that are within the scope of this invention, and descriptions of particular shapes or interactions between the components should not be considered limiting. Of course it is understood that the above is a description of the preferred embodiments, and that various changes and alterations can be made without departing from the spirit and broader aspects of the invention.

The invention claimed is:

1. A seating assembly, comprising:

first and second seating components said first seating component comprising a back and said second seating component comprising a base, said first and said second seating components are releasably secured together without the need for tools;

an interlocking system for releasably securing together said first and said second seating components, said interlocking system comprising:

at least one first interlocking element affixed or releasably securable to said first seating component;

at least one second interlocking element affixed or releasably securable to said second seating component;

said first interlocking element being releasably securable with said second interlocking element, for securing said first seating component to said second seating component;

at least one third component, wherein at least two of said first, second and third components interlock with each other through said interlocking system when said components are placed into position so as to form said seating assembly;

said seating assembly further comprising a seat, said seat being positioned above and supported by at least part of said base; and said seat is sandwiched between said back and said base when said back and said base are secured together by said interlocking system.

2. A seating assembly, comprising:

first and second seating components to be releasably secured together without the need for tools;

at least one strap latch to secure said components together, said strap latch comprising a strap with one end of the strap affixed to the first component and the other end of the strap affixed to a latch;

a catch member affixed to said second component;

said latch of said strap latch releasably engageable with the catch member to secure said first component to said second component;

at least one third component, wherein at least two of said components have features to interlock with each other when said components are placed in the position to form said seating assembly, such that said components are held together by the combination of said interlocking features and said strap latch; and said catch member for said strap latch includes a fulcrum which faces away from the direction from which said strap will approach the catch member when the strap latch is fastened, and a stop positioned further from the direction of approach of the strap than said fulcrum at a point over center relative to said fulcrum; the leading edge of said latch engaging said fulcrum, and the trailing edge of said latch being rotated through an arc passing beyond said fulcrum until it engages said stop; said strap being of such a length that it is put in tension as said trailing edge of said latch is rotated through said arc, such that when said latch engages said stop, said strap remains in tension, pulling said latch against said stop and locking said latch and said strap in position until a force is applied to rotate said latch away from said stop and back through said arc.

3. A multi-unit seating assembly, comprising:

a first chair, comprising a base and a seat;

a second chair comprising a base and a seat;

a strap latch, comprising a strap affixed to the first chair at one end of the strap and affixed to a latch at the other end of said strap, and a catch affixed to the second chair, wherein said strap latch is used to secure the first chair to the second chair; and a catch affixed to said first chair, whereby said strap can be coiled around said latch, and said latch can be releasably secured to said first chair catch when said strap is not in use in ganging said first chair to a second chair.

4. A seating assembly, comprising:

first and second seating components to be releasably secured without the need for tools;

at least one strap latch to secure said components together, said strap latch comprising a strap with one end of the strap affixed to the first component and the other end of the strap affixed to a latch;

a catch member attached to said second component;

said latch of said strap latch releasably engageable with the catch member to secure said first component to said second component; and said catch member for said strap latch includes a fulcrum which faces away from the direction from which said strap will approach the catch member when the strap latch is fastened; and a stop positioned further from the direction of approach of the strap than said fulcrum at a point over center relative to said fulcrum; the leading edge of said latch engaging said fulcrum, and the trailing edge of said latch being rotated through an arc passing beyond said fulcrum until it engages said stop; said strap being of such a length that it is put in tension as said trailing edge of said latch is rotated through said arc, such that when said latch engages said stop, said strap remains in tension, pulling said latch against said stop and locking said latch and said strap in position until a force is applied to rotate said latch away from said stop and back through said arc.

5. The seating assembly of claim 4 in which said leading edge of said latch includes a catch engaging surface, and projections on the outer sides of said catch engaging surface which prevent the latch from shifting side-to-side with respect to said catch engaging member as it is rotated into its locked position.

6. A multi-unit seating assembly, comprising:

a first chair, comprising a base and a seat;

a second chair comprising a base and a seat;

a strap latch, comprising a strap affixed to the first chair at one end of the strap and affixed to a latch at the other end of said strap, and a catch affixed to the second chair, wherein said strap latch is used to secure the first chair to the second chair; and said catch for said strap latch includes a fulcrum which faces away from the direction from which said strap will approach the latch when the strap latch is fastened, and a stop positioned further from the direction of approach of the strap than said fulcrum at a point over center relative to said fulcrum; the leading edge of said latch engaging said fulcrum, and the trailing edge of said latch being rotated through an arc passing beyond said fulcrum until it engages said stop; said strap being of such a length that it is put in tension as said trailing edge of said latch is rotated through said arc, such that when said latch engages said stop, said strap remains in tension, pulling said latch against said stop and locking said latch and said strap in position until a force is applied to rotate said latch away from said stop and back through said arc.

7. The seating assembly of claim 6 which includes a catch affixed to said first chair, whereby said strap can be coiled around said latch, and said latch can be releasably secured to said first chair catch when said strap is not in use in ganging said first chair to the second chair.

8. A seating assembly, comprising:

first and second seating components to be releasably secured together without the need for tools;

at least one strap latch to secure said components together, said strap latch comprising a strap with one end of the strap affixed to the first component and the other end of the strap affixed to a latch;

a catch member affixed to said second component;

said latch of said strap latch releasably engageable with the catch member to secure said first component to said second component;

a third component, wherein at least two of said components have features to interlock with each other when said components are placed in the position to form said seating assembly, such that said components are held together by the combination of said interlocking features and said strap latch;

said seating assembly further comprises a base, a seat and a back, said first and second components being said back and said base; said seat and said base including said interlocking features; and said seat being sandwiched between said back and said base when said back and said base are secured together by said strap latch and said catch member.

9. The seating assembly of claim 8 wherein said seat and base interlocking features comprise said base including a front base frame member having spaced slots therein; said seat having a front seat frame member with rearwardly extending projections therefrom located to engage said slots when said seat is properly located on said base.

10. The seating assembly of claim 8, wherein the seat comprises:

a fixed frame, including front and back members;

a floating frame member;

at least one strap, secured to and affixing said floating frame member to said back member of said fixed frame;

seat webbing, attached along one edge to said front member of said fixed frame and attached along the opposing edge to said floating frame member; and wherein said seat webbing and said strap have sufficient stretch to allow said floating frame member to be displaced in the downward direction when a downward force is applied to the seat webbing, such that the seat of the seating assembly appears flat when not occupied, but has a rearward and downward incline when occupied.

11. The seating assembly of claim 8 in which said catch member for said strap latch includes a fulcrum which faces away from the direction from which said strap will approach the catch member when the strap latch is fastened, and a stop positioned further from the direction of approach of the strap than said fulcrum at a point over center relative to said fulcrum; the leading edge of said latch engaging said fulcrum, and the trailing edge of said latch being rotated through an arc passing beyond said fulcrum until it engages said stop; said strap being of such a length that it is put in tension as said trailing edge of said latch is rotated through said arc, such that when said latch engages said stop, said strap remains in tension, pulling said latch against said stop and locking said latch and said strap in position until a force is applied to rotate said latch away from said stop and back through said arc.

12. The seating assembly of claim 8 wherein said back comprises:

two side members joining a back support;

a connecting brace, which extends between said side members and is fixedly attached at each end to one of the side members; and one end of said strap latch being attached to said connecting brace and said catch being attached to said base.

13. The seating assembly of claim 12, wherein said back support comprises webbing attached to the forward portions of said side members; said side members being shaped to provide ergonomic support to an occupant of the chair.

14. The seating assembly of claim 8, wherein said base accommodates an arm; said arm being releasably fastened to said base using a second strap latch.

15. The seating assembly of claim 14, wherein said arm and said seat include said interlocking features, whereby said arm is releasably secured to said base by said seat as well as said second strap latch.

16. The seating assembly of claim 15 in which said catch member for said strap latch includes a fulcrum which faces away from the direction from which said strap will approach the catch member when the strap latch is fastened, and a stop positioned further from the direction of approach of the strap than said fulcrum at a point over center relative to said fulcrum; the leading edge of said latch engaging said fulcrum, and the trailing edge of said latch being rotated through an arc passing beyond said fulcrum until it engages said stop; said strap being of such a length that it is put in tension as said trailing edge of said latch is rotated through said arc, such that when said latch engages said stop, said strap remains in tension, pulling said latch against said stop and locking said latch and said strap in position until a force is applied to rotate said latch away from said stop and back through said arc.

17. The seating assembly of claim 15 comprising a second seating assembly releasably ganged to the first seating assembly by a strap latch, wherein the strap latch comprises a strap affixed at one end to one of said first and second seating assemblies and affixed to a latch at the other end of the strap, and said catch member affixed to the other of said seating assemblies, wherein said strap latch is used to secure the first seating assembly to the second seating assembly.

18. The seating assembly of claim 17 in which said catch member for said strap latch includes a fulcrum which faces away from the direction from which said strap will approach the catch member when the strap latch is fastened, and a stop positioned further from the direction of approach of the strap than said fulcrum at a point over center relative to said fulcrum; the leading edge of said latch engaging said fulcrum, and the trailing edge of said latch being rotated through an arc passing beyond said fulcrum until it engages said stop; said strap being of such a length that it is put in tension as said trailing edge of said latch is rotated through said arc, such that when said latch engages said stop, said strap remains in tension, pulling said latch against said stop and locking said latch and said strap in position until a force is applied to rotate said latch away from said stop and back through said arc.

19. The seating assembly of claim 15 wherein said arm and seat interlocking features include at least one interlocking projection on said arm which projects laterally into a portion of said base which accommodates said seat; and said seat includes a side rail which is seated over said arm projection to lock it in place when said seat is properly located on said base.

20. The seating assembly of claim 19 wherein said seat and base interlocking features comprise:

said base including a front base frame member having spaced slots therein; said seat having a front seat frame member with rearwardly extending projections located to engage said slots when said seat is properly located on said base.

21. The seating assembly of claim 20 wherein said back comprises:

two side members joining a back support;

a connecting brace, which extends between said side members and is fixedly attached at each end to one of the side members; and one end of said strap latch being attached to said connecting brace and said catch member being attached to said base.

22. The seating assembly of claim 21 in which said catch member for said strap latch includes a fulcrum which faces away from the direction from which said strap will approach the catch member when the strap latch is fastened, and a stop positioned further from the direction of approach of the strap than said fulcrum at a point over center relative to said fulcrum; the leading edge of said latch engaging said fulcrum, and the trailing edge of said latch being rotated through an arc passing beyond said fulcrum until it engages said stop; said strap being of such a length that it is put in tension as said trailing edge of said latch is rotated through said arc, such that when said latch engages said stop, said strap remains in tension, pulling said latch against said stop and locking said latch and said strap in position until a force is applied to rotate said latch away from said stop and back through said arc.

* * * * *